US005277260A

United States Patent [19]

Ranck

[11] Patent Number: 5,277,260

[45] Date of Patent: Jan. 11, 1994

[54] AIR HAMMER

[76] Inventor: Gerald L. Ranck, 2439 Old Philadelphia Pike, Lancaster, Pa. 17602

[21] Appl. No.: 22,011

[22] Filed: Feb. 24, 1993

[51] Int. Cl.[5] ..... B25D 9/04

[52] U.S. Cl. ..... 173/17; 173/128; 173/212

[58] Field of Search ..... 173/17, 211, 128, 162.1, 173/210, 212

[56] References Cited

U.S. PATENT DOCUMENTS

| | | | |
|---|---|---|---|
| 3,527,239 | 9/1970 | Boom | 173/17 |
| 3,599,730 | 8/1971 | Tyreso et al. | 173/17 |
| 3,606,930 | 9/1971 | Curington | 173/17 |
| 3,804,181 | 4/1974 | Curington et al. | 173/17 |
| 4,084,646 | 4/1978 | Kurt | 173/17 |
| 4,591,004 | 5/1986 | Gien | 173/17 |
| 4,790,390 | 12/1988 | Sweeny | 173/17 |

*Primary Examiner*—Scott Smith

[57] ABSTRACT

A percussion drilling apparatus having an outer casing, a fluted inner sleeve affixed to the outer casing, a hammer piston having a longitudinal opening therethrough adapted to fit around extensions of a cyclic valve positioned at the top of the inner casing, and a foot valve mounted atop a drilling bit at the bottom of the apparatus. An air channel positioned between the inner sleeve and outer casing is adapted to cooperate with channels on a reciprocating hammer piston to alternately drive the hammer piston up and down.

4 Claims, 2 Drawing Sheets

AIR HAMMER

BACKGROUND OF THE INVENTION

This invention relates to an air operated impact hammer adopted to drill bore holes through solid rock. The hammer itself is adapted to be attached to a drill string which conveys air under pressure to the hammer, the air pressure normally coming from air compressors at the surface. The air-conveying drill string may rotate as the hammer positioned at its lower end does its job of cutting away through rock. The air inside the hammer ultimately exhausts through the bottom of the hammer where the drilling bit is positioned. The rising stream of air thus carrying to the surface dust, sands and rock fragments cut by the hammer as it drills through the rock.

The particular efficacy of this air hammer is its simplicity. Other than the hammer piston inside the outer casing of the hammer, there are no moving parts to channel the air appropriately both to lift and to drive down the hammer piston. Thus the reciprocating hammer piston, in addition to striking the bit with sufficient force to chip away rock, also serves to direct air through the appropriate ports inside the hammer as the hammer piston reciprocates. Accordingly, it is the primary object of the present invention to supply a simplified and efficient air supply to its hammer which makes it capable of use for extended periods of time without shutdowns caused by wear of internal parts, plugging of moving parts, or other operational hazards.

DESCRIPTION OF THE PREFERRED EMBODIMENT

Figure 1:
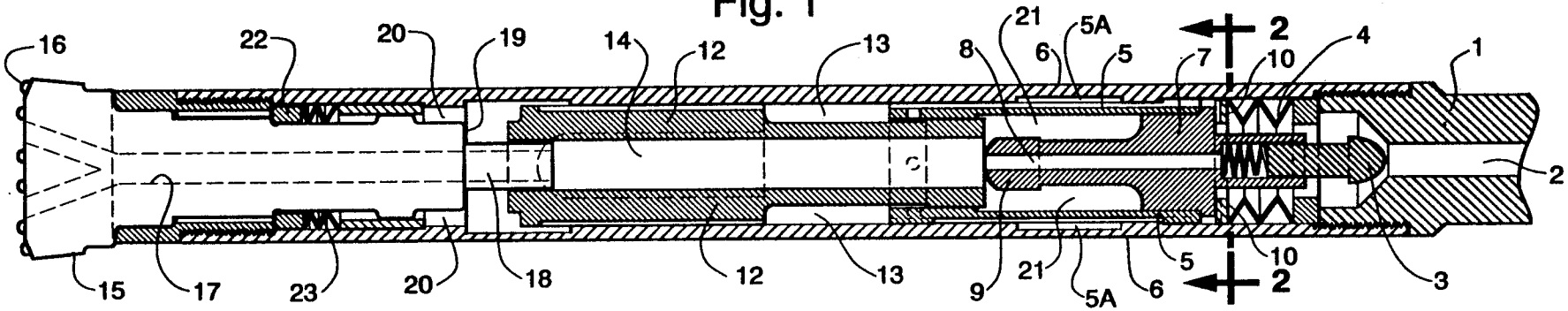
FIG. 1 is a longitudinal sectional view through the working head portion of the hammer.
Figure 2:
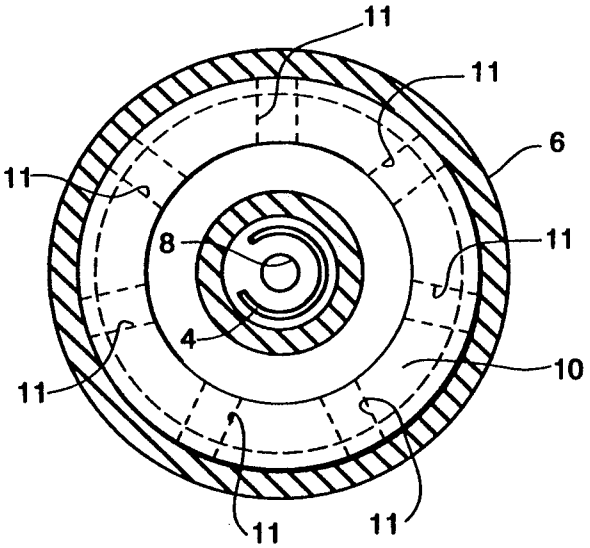
FIG. 2 is a transverse sectional view taken on the line 2—2 of FIG. 1 through the cyclic valve just above the air metering ring.

Referring to FIG. 1, the adapter 1 to connect the apparatus to the bottom of the drill string conveys air through the air channel 2 past the check valve dart 3 having the spring 4 which pushes the check valve dart 3 into a closed position when no air is coming through the air channel 2. Air pressure will generally range 150–500 pounds per square inch, and preferably in the range of 250–350 pounds per square inch. An inner sleeve 5 is mounted inside the outer casing 6, a cyclic valve 7 mounted in the interior upper end and on top of inner sleeve 5, the cyclic valve 7 having a cyclic valve air channel 8 passing through a depending guide member 9 which is part of the cyclic valve 7 to supply additional cleaning air. Positioned between the inner surface of the outer casing 6 and the outer surface of the inner sleeve 5 are air conveying flutes 5A. Positioned at the top of the cyclic valve 7 is the air metering ring 10. The air metering ring 10 contains multiple channels 11 to convey air from the top of the cyclic valve 7 to the flutes 5A positioned between the outer casing 6 and the inner sleeve 5. This air metering ring 10 lies at the heart of the present invention since it serves to direct air to the flutes 5A on the outside of the inner sleeve 5 and thus provides a simple method of matching the air supply to the entire hammer to the available air being delivered from the surface, and also serves to adapt the available air supply to any of a variety of drilling conditions.

The hammer piston 12 acts as an air flow control valve as it moves from the top to the bottom of each stroke. To this end, piston undercut 13 aids in driving the hammer piston 12 up and down as the piston undercut 13 always contains air as do the outer flutes 5A. The piston channel 14 runs entirely through the hammer piston 12 from the top to the bottom. The bit 15, normally carrying drilling studs 16 has a central airway 17 terminating in the foot valve 18 which fits into the pistol channel 14 at the bottom of the downstroke of the hammer piston 12. Thus, when the hammer piston 12 nears the top of its stroke, available air discharges through the central airway 17 serving to blow drilling debris past the outer casing 6 to the surface. The impact surface 19 surrounds the foot valve 18, often made of nylon, and converts the downward stroke of the hammer piston 12 into rock penetrating energy for the studs 16 at the bottom of each downward stroke of the hammer piston 12.

Figure 3:
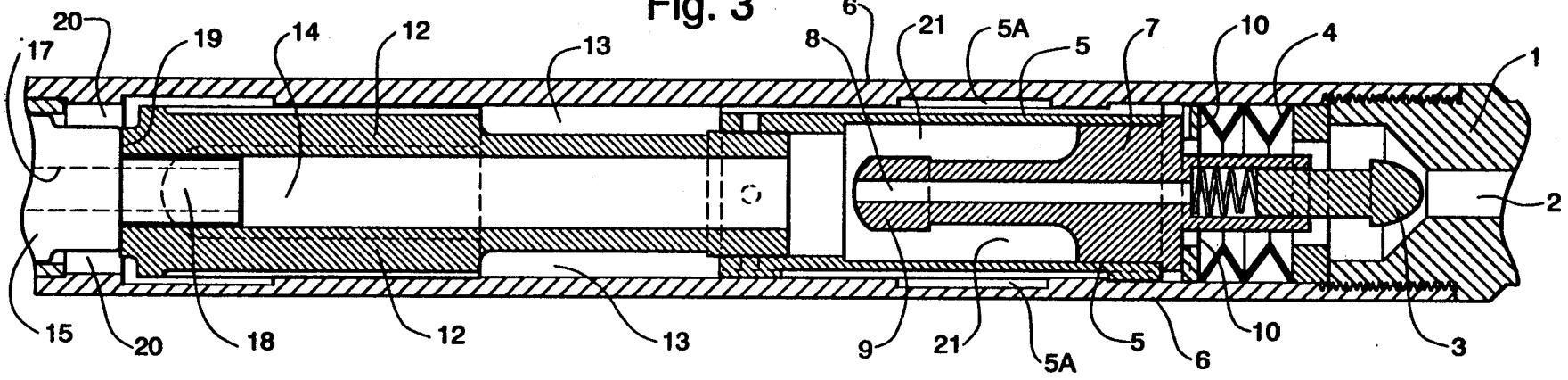
FIG. 3 is an enlarged fragmentary sectional view similar to FIG. 1 showing the piston at the bottom of its stroke at impact with the bit, positioned to start its upward return stroke.

Referring to FIG. 3, the hammer piston 12 is shown at the bottom of its stroke in which the hammer piston 12 has struck the impact surface 19. At this juncture, the air entering through air channel 2 now can pass down the length of the entire hammer, being directed by the air meter ring 10 through the channels 11, through flutes 5*a*, down inside the outer casing 6 to the lifting chamber 20. The air pressure thus applied in addition to that in the piston undercut 13 drives the hammer piston 12 upwards.

Figure 4:
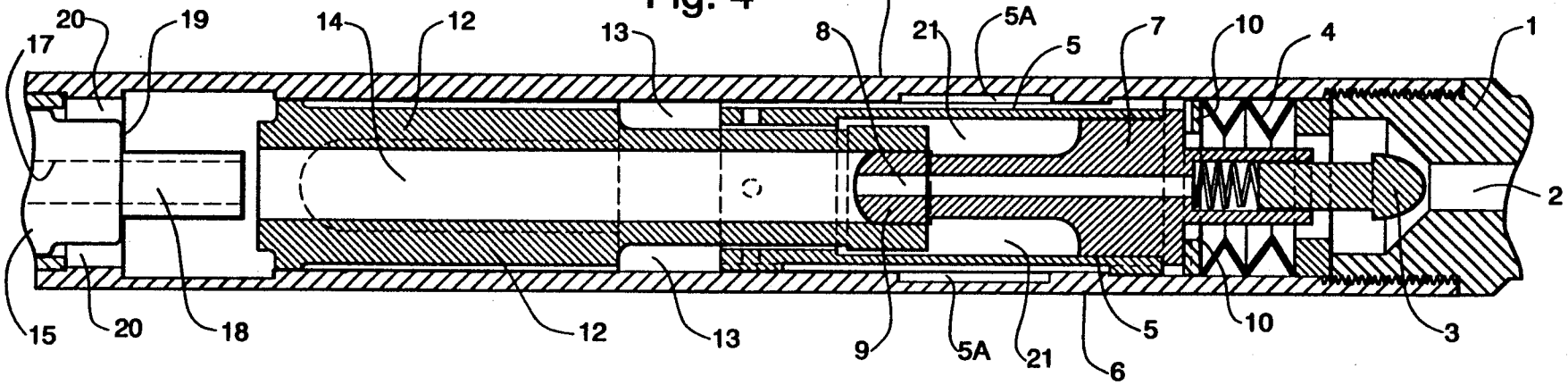
FIG. 4 is similar to FIG. 3 but showing the piston near the top of its upward stroke positioned to start down again.

FIG. 4 shows the hammer piston 12 near the uppermost part of its stroke in which the depending guide member 9 has fitted inside the piston channel 14, thus creating the air cushion 21. Once the depending guide member 9 seals off the top of the piston channel 14, the air cushion 21 is a chamber in which the compressed air serves to stop the upward drive of the hammer piston 12 by virtue of the increasing pressure in the air cushion 21. As the air pressure in air cushion 21 becomes great enough, the hammer piston 12 will stop its upward drive by virtue of the increased pressure in the air cushion 21 which will start to expand and help drive the hammer piston 12 in its downward stroke.

The total length of the stroke of the hammer piston 12 is generally about 4 inches. The hammer piston 12 generally weighs 45–60 pounds but can be more or less depending on the application, and have a cycle from the end of one stroke to the same position at the next stroke of about one second.

The bit 15 necessary for the air hammer operation forms no part of the present invention. There are several bits available on the market which can be used with the air hammer described herein. As an example of a suitable means of attaching a bit to the air hammer of the present invention, referring to FIG. 1, the bit 15 extends up inside the outer casing 6 held in place by a chuck 23 and a bit retainer ring 22. The bit retainer ring 22 allows bit 15 to have a motion independent of the movement of the outer casing 5. During the actual operation of the hammer, it will sometimes be advisable to raise the hammer from its contact with the bottom of the hole by lifting the drill string attached to the adapter 1. In this posture, air blasts through the entire length of the hammer and out the bottom of bit 15 and serves to blow the drill hole free of debris.

I claim:

1. In a percussion drilling apparatus having a fluted outer casing having at one end thereof a means of attachment to a rotating air-conveying drill string and having at another end thereof a drilling bit, the apparatus also having a hammer piston having a central piston channel serving as a valve system for controlling an airflow system to alternately raise and lower the hammer piston and having a spring-driven check valve positioned at a top of the outer casing adapted for plugging an entrance airway when airflow in the drill string is shut off, the improved airflow system comprising an inner sleeve affixed to the interior of the outer casing and positioned immediately beneath said check valve, a fixed cyclic valve positioned at a top of the inner sleeve and having a depending hollow tube receivable into the central piston channel of the hammer piston when the hammer piston is in a raised position, an upper end of the hammer piston and an inside of the inner sleeve forming an air cushion chamber to hold compressed air to stop the upward stroke of the hammer piston and to exert force to start the downward stroke of said hammer piston, an air-metering ring positioned beneath the check valve and on top of the inner sleeve and wholly inside the outer casing and having a central, air-conveying opening and radial grooves for conveying air to interior air channels formed between the outside of the inner sleeve and the inside of the casing, the interior air channels being recessed outwardly within said outer casing at a top of the upward stroke and at a position slightly above the site where the hammer piston strikes a top of the bit at the lowest portion of the piston downstroke, the recessed channels being formed in the inside of the outer casing for lowering the air pressure on the hammer piston near the bottom of the downstroke, and additional air channels of lesser diameter than the recessed air channels for applying air pressure to the hammer piston in an upwardly direction, whereby the airflow alternately raises and lowers the hammer piston.

2. In a percussion drilling apparatus according to claim 1 operating at an air pressure in the range of 150–500 pounds per square inch.

3. A percussion drilling apparatus according to claim 1 operating at an air pressure in the range of 250–350 pounds per square inch.

4. A percussion drilling apparatus according to claim 1 having a nylon foot valve mounted at the top of the bit.

* * * * *